US008650989B1

(12) United States Patent
Bremer, Jr.

(10) Patent No.: US 8,650,989 B1
(45) Date of Patent: Feb. 18, 2014

(54) ROOFING MATERIAL REMOVAL DEVICE

(76) Inventor: Karl W. Bremer, Jr., Zuni, VA (US)

( * ) Notice: Subject to any disclaimer, the term of this patent is extended or adjusted under 35 U.S.C. 154(b) by 280 days.

(21) Appl. No.: 13/287,263

(22) Filed: Nov. 2, 2011

(51) Int. Cl.
*E04D 15/00* (2006.01)

(52) U.S. Cl.
USPC ..... 81/45; 30/170

(58) Field of Classification Search
USPC ..... 81/45, 46; 30/170; 299/36.1, 37.1, 39.1; 52/749.12
See application file for complete search history.

(56) References Cited

U.S. PATENT DOCUMENTS

| | | | | |
|---|---|---|---|---|
| 2,005,630 | A | 6/1935 | Overell | |
| 2,707,361 | A | 5/1955 | Thomas | |
| 2,733,739 | A | 2/1956 | Rocklin | |
| 3,080,696 | A | 3/1963 | Wood | |
| 3,695,713 | A | 10/1972 | Rothi et al. | |
| 3,779,605 | A | 12/1973 | Nieman | |
| 4,277,104 | A | 7/1981 | Sanchez | |
| 4,294,046 | A | 10/1981 | Damiano | |
| 4,478,028 | A | 10/1984 | Dawson, Jr. | |
| 4,551,967 | A | 11/1985 | Murcko | |
| 5,009,131 | A | 4/1991 | Alto et al. | |
| 5,641,206 | A | 6/1997 | Craft | |
| 5,904,033 | A | 5/1999 | Landeis | |
| 6,116,117 | A | 9/2000 | Nicolosi et al. | |
| 6,135,566 | A | 10/2000 | Anderson | |
| 6,393,948 | B1 * | 5/2002 | Hutchins | 81/45 |
| 7,127,968 | B1 | 10/2006 | Kriegar | |
| 7,685,909 | B1 | 3/2010 | Jones | |
| 2004/0083679 | A1 | 5/2004 | Shinn et al. | |
| 2004/0123554 | A1 | 7/2004 | Slack | |
| 2006/0117910 | A1 * | 6/2006 | Gendron | 81/45 |
| 2006/0179790 | A1 | 8/2006 | Bremer, Jr. | |
| 2007/0245684 | A1 | 10/2007 | Bremer, Jr. | |

FOREIGN PATENT DOCUMENTS

| | | | |
|---|---|---|---|
| JP | 406233607 | A | 8/1994 |

OTHER PUBLICATIONS

Garlock Equipment Company; Roof Warrior Brochure; 2000; US.
Garlock Equipment Company; Enforce Advertisement; US.

* cited by examiner

*Primary Examiner* — David B Thomas
(74) *Attorney, Agent, or Firm* — Wooten & Shaddock, PLC

(57) ABSTRACT

A roofing material removal device that includes a wheeled frame, a plurality of vertical cutting blades being secured to a front of the wheeled frame, each of the vertical cutting blades being rotatable about a substantially horizontal axis, at least one horizontal cutting blade being secured to the wheeled frame, the horizontal cutting blade being slidable in a lateral motion along a substantially horizontal plane, a first motor being coupled to the vertical cutting blades for rotating the vertical cutting blades, and a second motor being coupled to the horizontal cutting blade for moving the horizontal cutting blade in a lateral motion.

20 Claims, 15 Drawing Sheets

ROOFING MATERIAL REMOVAL DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING

Compact Disc Appendix

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. All trademarks and service marks identified herein are owned by the applicant.

BACKGROUND OF THE INVENTION

1. Field of the Invention

This invention relates generally to an improved roofing material removal device. More particularly, the invention relates to an improved roofing material removal device that is mounted within a wheeled frame for removing a roof membrane and/or insulation layer from a roof and cutting case hardened steel screws and all types of mechanical fasteners.

2. Description of Related Art

There are two types of roofs that are most commonly seen today, low-slope and steep-slope roofs. Low-slope roofs are used mostly for commercial and industrial buildings; however, some residential buildings such as town homes and apartments will also use low-slope roofs.

Low slope roofs are also referred to as "flat roofs" although the roofs are not strictly flat. Most low-slope roofs have a small slope of about ¼ inch per foot, sometimes greater depending on the size of the building, to provide adequate drainage. Whenever a building does not have a proper drainage system, which will be discussed later, water tends to build up on the roof. Water buildup, or "ponding", on the roof will cause the structure of the building to deflect and could lead to permanent structural damage of the building. Sagging roof joists will allow water to build up in the middle of the roof and make perimeter drains ineffective. If the structural deflection increases and is not prevented the overloaded structure could collapse. A puddle of water measuring 20 feet in width by 20 feet in length with 1 inch in depth will apply one time of weight pressure on the roof.

The membranes for low-slope roofs are divided into three general categories: the built-up roof membrane, the single-ply roof membrane, and the fluid-applied membrane.

Built-up roofing systems can be installed on buildings with either a concrete or a steel deck. Although the roofs are applied slightly different due to the nature of the roof deck there are similarities to their structure and material. Steel deck roofs start out with a layer of insulation boards that are mechanically fastened to the deck. Each of the four layers of the roof membrane, two layer of insulation, one of felt, and the final layer of aggregate (in that order), are held together by a layer of asphalt. The concrete deck roofs must have an asphalt primer applied before the first layer of asphalt can be put down. A layer of felt is then laid in place with another coat of asphalt on top with the insulation boards and final layer of aggregate put in place. The asphalt is used as a bonding agent on these roofs. If water or air gets trapped between layers of the membrane or between the sheathing and the membrane it will cause a blister to form, moving the gravel or aggregate and exposing the blister to ultraviolet or mechanical damage. A ruptured blister will create a crater that permits water penetration, which will eventually weaken and damage the roof.

The single-ply roofing membrane is a rapidly growing system today. These systems are installed in one single layer requiring less cost for labor time and materials. Single-ply roofs can be attached to a building by using several different methods: adhesives (cold or hot), ballast, fasteners that are hidden in the seams, or by mechanical fasteners that do not penetrate the membrane. Single-ply membranes can be either a large single "sheet" that once unfolded will cover the entire roof with no seams, or it can be separate rolls ranging from 3' to 10' in width, when once laid will have seams that must be sealed. The materials that are used for single-ply roofing systems are divided into two categories, thermoplastics and thermosetting. Hot air welding or solvent welding can join thermoplastic materials, however adhesives or pressure-sensitive tape must join thermosetting material. Thermoplastic materials are made up of the following: polyvinyl chloride (PVC), polymer-modified bitumens, PVC alloys, chlorinated polyethylene (CPE), polyisobutylene (PIS), and thermoplastic olefin (TPO). Thermosetting materials are made up of the following: ethylene propylene diene monomer (EPDM), chlorosulfonated polyethylene (CSPE), epichlorhydrin, and neoprene. PVC roofs may become brittle in cold weather especially if the membrane is tight. Shrinkage is another problem common with PVC roofs. It can cause separation from roof projections (plumbing vents or skylights) and edges. Some other problems caused by incorrect installation are wrinkles, ruptures, and "fishmouth" (separations at seams). Modified bitumen roof membranes must be protected from ultraviolet light by one of the following: a granular surface, a liquid coating (usually reflective), a foil surface, or ballast (usually gravel or aggregate), Ethylene propylene diene monomer (EPDM) roofs have a tendency toward thermal expansion and contraction. A tight EPDM roof may have problems around the perimeters and flashings where the membrane could pull away from its fasteners.

The fluid-applied membranes are mostly used for buildings with domes, shells, or unusual shapes. Either a roller or a spray gun, both of which usually require several coats, is used to apply this type of membrane.

Most low-slope roofs are covered with a ballast of either loose gravel or concrete blocks. The purpose of the ballast is to keep the membrane from being picked up by the wind, and to provide protection against the ultraviolet rays of the sun.

Membranes for low-sloped roofs are sealed at the edges by being glued to the parapet wall with fabric and mastic and covered by flashing. The parapet is part of the exterior wall that extends above the roof. The coping, or covering, of the parapet provides the final seal for the roof. It is designed with drip grooves along the edges to prevent water from running back under the coping and seeping into the membranes of the roof. A cant strip of wood or fiber is placed under the roof membrane along the edge of the roof and around any area of penetration (plumbing vents and skylights) to ease the bending so that it can be sealed to the wall. It also prevents standing water from collecting at the edge of the membrane.

There are two methods by which a low-sloped roof can be properly drained. One method of drainage is called Scuppers, which are placed along the edge of the building. A scupper is an opening in the parapet that allows water to drain off the edge of the roof into gutters and downspouts. Interior roof drains on the area of the roof provide the second and most common method of drainage. These drains are mechanically fastened at precise intervals to the roof of the building and are used to prevent the buildup of water as mentioned earlier. They are also covered with a strainer to avoid clogging of the drainage system.

Other features commonly found with low-sloped roofs are building separation joints and area dividers. The separation joint allows for the joining of separate parts of one structure or the joining of two structures that were built side by side. The joints are made to be flexible and waterproof so as not to tear and leak while allowing for the large differential movements between the adjoining parts. The purpose of the area divider is to allow for movement in the membrane itself and not the whole building. It is mostly used to divide a large roofing area to allow for thermal movement.

Single-ply low-slope roofing systems, "rubber roofs", are becoming more widely used due to the ease of installations, lower labor cost, and they are less prone to leaks and cracks.

Impermeable rubber membranes positioned atop foam insulation is commonly used to make watertight roofs on commercial buildings. Over time, these membranes deteriorate, necessitating their periodic replacement.

Many roofing companies employ handheld tools to remove the weathered roofing membranes and foam insulation in order to minimize the likelihood of damaging roof decking plates and other roof features.

SUMMARY OF THE INVENTION

Unfortunately, the process of removing a roof membrane and mechanical fasteners is slow and labor intensive, especially with manually powered, handheld tools.

Thus, in light of the problems associated with the known tools and methods for removing membranes, foam insulation, and mechanical fasteners from roofs, the present invention is directed to an improved cutting device. More particularly, the invention relates to an improved cutting device that is mounted within a wheeled frame for removing a roof membrane and/or insulation layer and the associated mechanical fasteners from a roof.

In various exemplary embodiments, the roofing material removal device according to this invention comprises a wheeled frame having manually operated valves at the rear thereof for steering by a walking or riding attendant.

A source of pressurized hydraulic fluid is secured to the frame. Drive wheels are secured to the rear of the frame for propelling the roofing material removal device over a roof.

A horizontal cutting blade is secured to the frame. The horizontal cutting blade moves laterally in a substantially horizontal plane. A first hydraulic motor is connected to a source of pressurized hydraulic fluid and is connected to the horizontal cutting blade for driving the horizontal cutting blade. During operation of the cutting and attachment device, the horizontal cutting blade acts to cut through the mechanical fasteners used to hold the roof membrane and/or roof insulation in place.

In various exemplary, nonlimiting embodiments, two vertical cutting blades are also secured to the frame. If more than one vertical cutting blade is included, the vertical cutting blades are spaced apart from one another. The vertical cutting blades are rotatable in a substantially vertical plane. A second hydraulic motor is connected to the source of pressurized hydraulic fluid for rotating the vertical cutting blades. During operation of the cutting and attachment device, the vertical cutting blades act to cut through the roof membrane and/or roof insulation into elongated strips that are easy to handle.

A third and fourth hydraulic motor are connected to the source of pressurized hydraulic fluid. Each of the third and fourth hydraulic motors is connected, via a hydraulic transmission, to a drive wheel for rotating the respective drive wheel and moving the frame.

A primary engine is secured to the frame for pressurizing the hydraulic fluid to power the hydraulic motors.

In one exemplary, nonlimiting embodiment of the present invention, the roofing material removal device includes a wheeled frame, a plurality of vertical cutting blades being secured to a front of the wheeled frame, each of the vertical cutting blades being rotatable about a substantially horizontal axis, at least one horizontal cutting blade being secured to the wheeled frame, the horizontal cutting blade being slidable in a lateral motion along a substantially horizontal plane, a first motor being coupled to the vertical cutting blades for rotating the vertical cutting blades, and a second motor being coupled to the horizontal cutting blade for moving the horizontal cutting blade in a lateral motion.

In another exemplary, nonlimiting embodiment of the present invention, the roofing material removal device includes a wheeled frame, a pair of drive wheels being secured to a rear portion of the frame for propelling the device, a plurality of vertical cutting blades being secured to a front of the wheeled frame, each of the vertical cutting blades being rotatable about a substantially horizontal axis, at least one horizontal cutting blade being secured to the wheeled frame, the horizontal cutting blade being slidable in a lateral motion along a substantially horizontal plane, a first motor being coupled to the vertical cutting blades for rotating the vertical cutting blades, a second motor being coupled to the horizontal cutting blade for to moving the horizontal cutting blade in a lateral motion, a third motor being connected to one of the drive wheels for rotating the drive wheel, and a forth motor being connected to one of the drive wheels for rotating the drive wheel.

In yet another exemplary, nonlimiting embodiment of the present invention, the roofing material removal device includes a wheeled frame, a source of pressurized hydraulic fluid being secured to the frame, a pair of drive wheels being secured to a rear portion of the frame for propelling the device, a plurality of vertical cutting blades being secured to a front of the wheeled frame, each of the vertical cutting blades being rotatable about a substantially horizontal axis, at least one horizontal cutting blade being secured to the wheeled frame, the horizontal cutting blade being slidable in a lateral motion along a substantially horizontal plane, a first motor being connected to the source of pressurized hydraulic fluid and being coupled to the vertical cutting blades for rotating the vertical cutting blades, a second motor being connected to the source of pressurized hydraulic fluid and being coupled to the horizontal cutting blade for moving the horizontal cutting blade in a lateral motion, a third motor being connected to the source of pressurized hydraulic fluid and being connected to one of the drive wheels for rotating the drive wheel, and a forth motor being connected to the source of pressurized hydraulic fluid and being connected to one of the drive wheels for rotating the drive wheel.

During operation of the roofing material removal device, the horizontal cutting blade operates to cut through the mechanical fasteners used to hold the roof membrane and/or roof insulation in place and the vertical cutting blades operate to cut the roof membrane and/or roof insulation into elongated strips. The elongated strips and remnants of the fasteners can be easily collected for removal from the roof at disposal.

Accordingly, this invention provides a roofing material removal device that eliminates the handwork involved in detaching mechanical fasteners, a roof membrane, and/or insulation layer from a roof.

This invention separately provides a motorized roofing material removal device.

This invention separately provides a roofing material removal device that rapidly detaches mechanical fasteners, a rubber membrane, and its associated foam insulation from a roof.

This invention separately provides a roofing material removal device that detaches mechanical fasteners, a rubber membrane, and its associated foam insulation from a roof without damaging the underlying decking that supports the membrane and insulation.

This invention separately provides a roofing material removal device that detaches mechanical fasteners, a rubber membrane, and its associated foam insulation from a roof in a single pass with minimal surface vibration and no sparking.

This invention separately provides a roofing material removal device that is relatively compact in size.

This invention separately provides a roofing material removal device that is relatively lightweight.

This invention separately provides a roofing material removal device that is less likely to damage roof decking.

This invention separately provides a roofing material removal device having a 360° turning radius that can be easily maneuvered in tight spaces.

This invention separately provides a roofing material removal device that has a self-contained power source so it does not need to be tethered by cables to a remote generator or electrical grid.

These and other features and advantages of this invention are described in or are apparent from the following detailed description of the exemplary embodiments.

BRIEF DESCRIPTION OF THE DRAWINGS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

For simplicity and clarification, the design factors and operating principles of the components of the roofing material removal device of this invention are explained with reference to various exemplary embodiments of the components of the roofing material removal device according to this invention. The basic explanation of the design factors and operating principles of the roofing material removal device is applicable for the understanding, design, and use of the roofing material removal device of this invention.

It should be appreciated that the terms "cutting", "cutting blade", and "detachment" are used for basic explanation and understanding of the systems, methods, and/or apparatuses of this invention. Therefore, the terms "cutting", "cutting blade", and "detachment" are not to be construed as limiting the systems, methods, and apparatuses of this invention.

It should also be appreciated that while the various exemplary embodiments of the present invention are primarily described and shown as being used to cut and detach mechanical fasteners, a roof membrane, and/or insulation layer from a roof they should not be construed as limiting the usage of the present invention. Thus, it should be understood that the roofing material removal device of the present invention can be used to remove alternate roof membrane or other insulation layers from a roof.

It should be understood that the absence of specific detail regarding the techniques used to gather and dispose of the removed roof membrane and/or insulation layer components that result from the use of the cutting and attachment device of the present invention is intentional as the roofing material removal device is designed to be utilized with a wide variety and combination of disposal techniques and methods.

Figure 1:
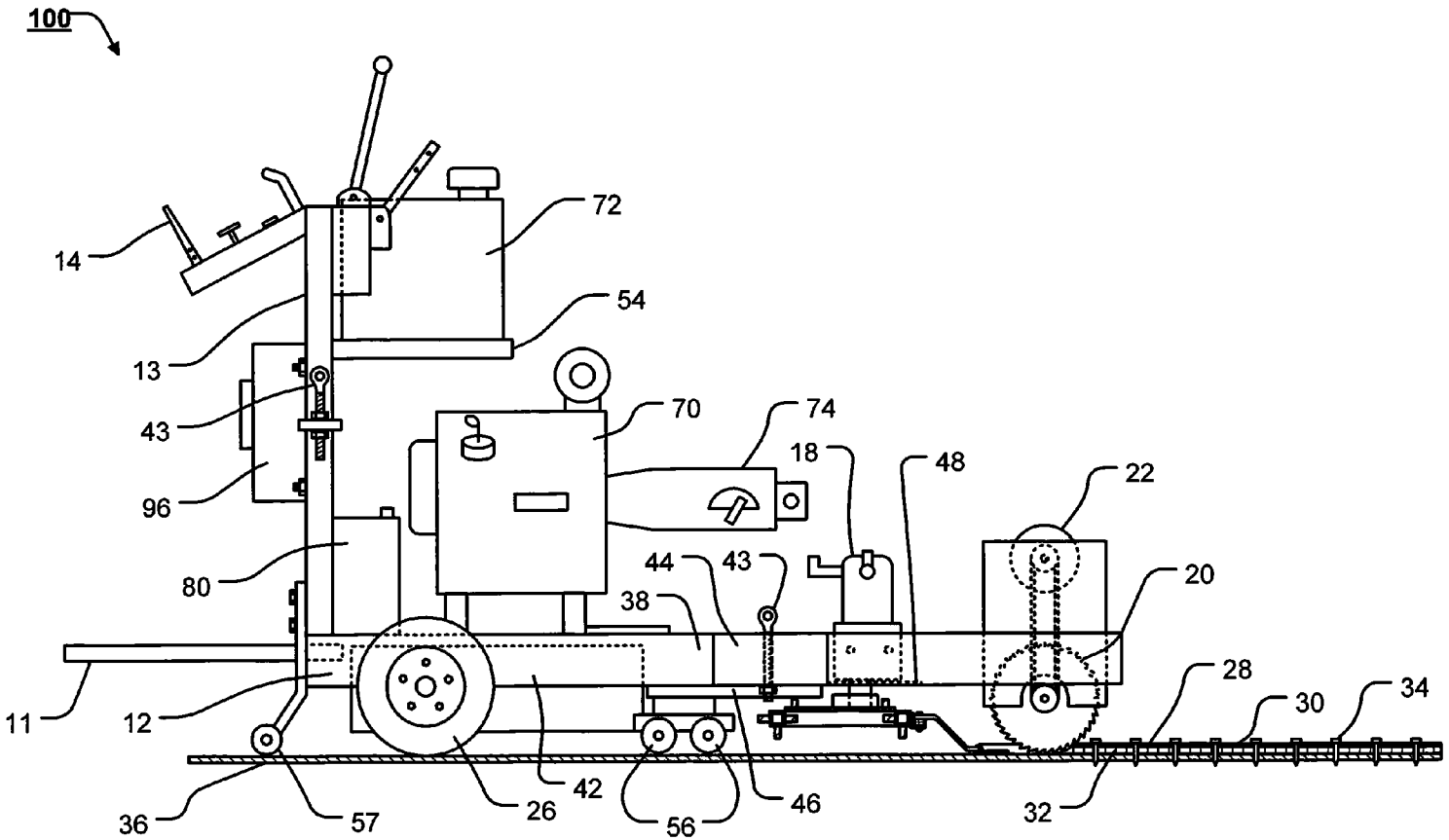
FIG. 1 shows a side view of a roofing material removal device according to this invention, wherein the hydraulic fluid conduits are detached.
Figure 2:
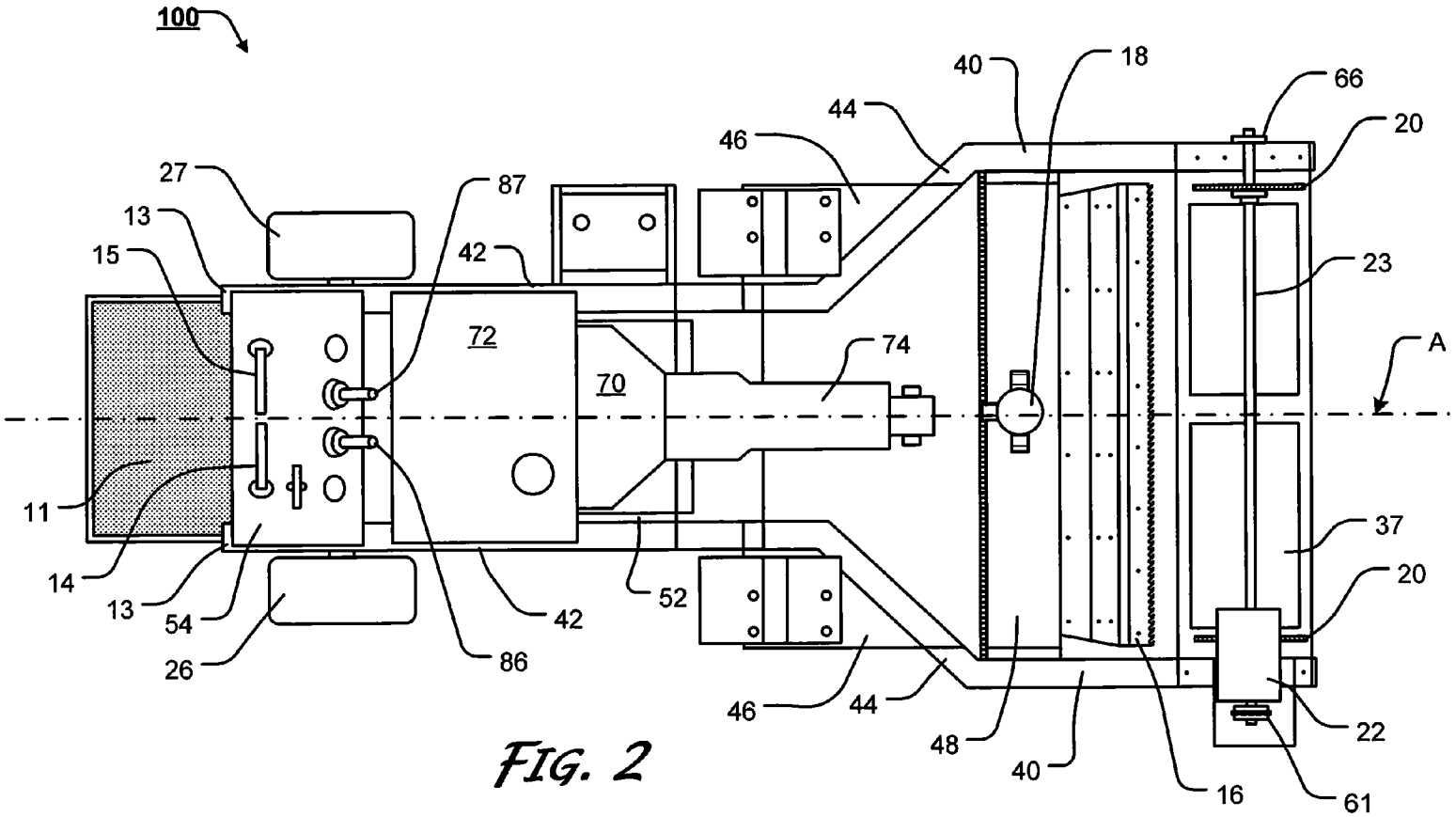
FIG. 2 shows a top view of a roofing material removal device according to this invention, wherein the hydraulic fluid conduits are detached.
Figure 3:
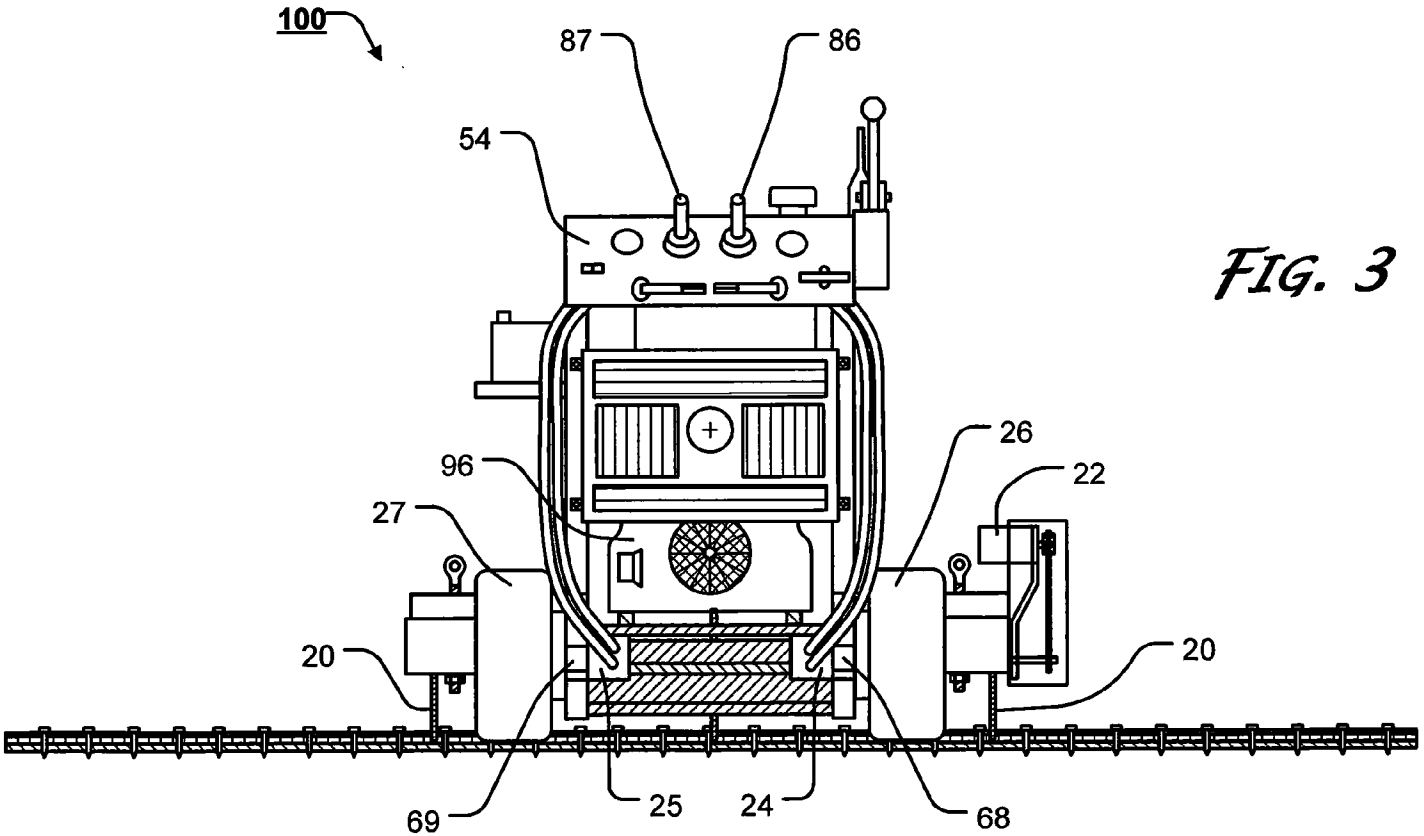
FIG. 3 shows a rear view of a roofing material removal device according to this invention.
Figure 4:
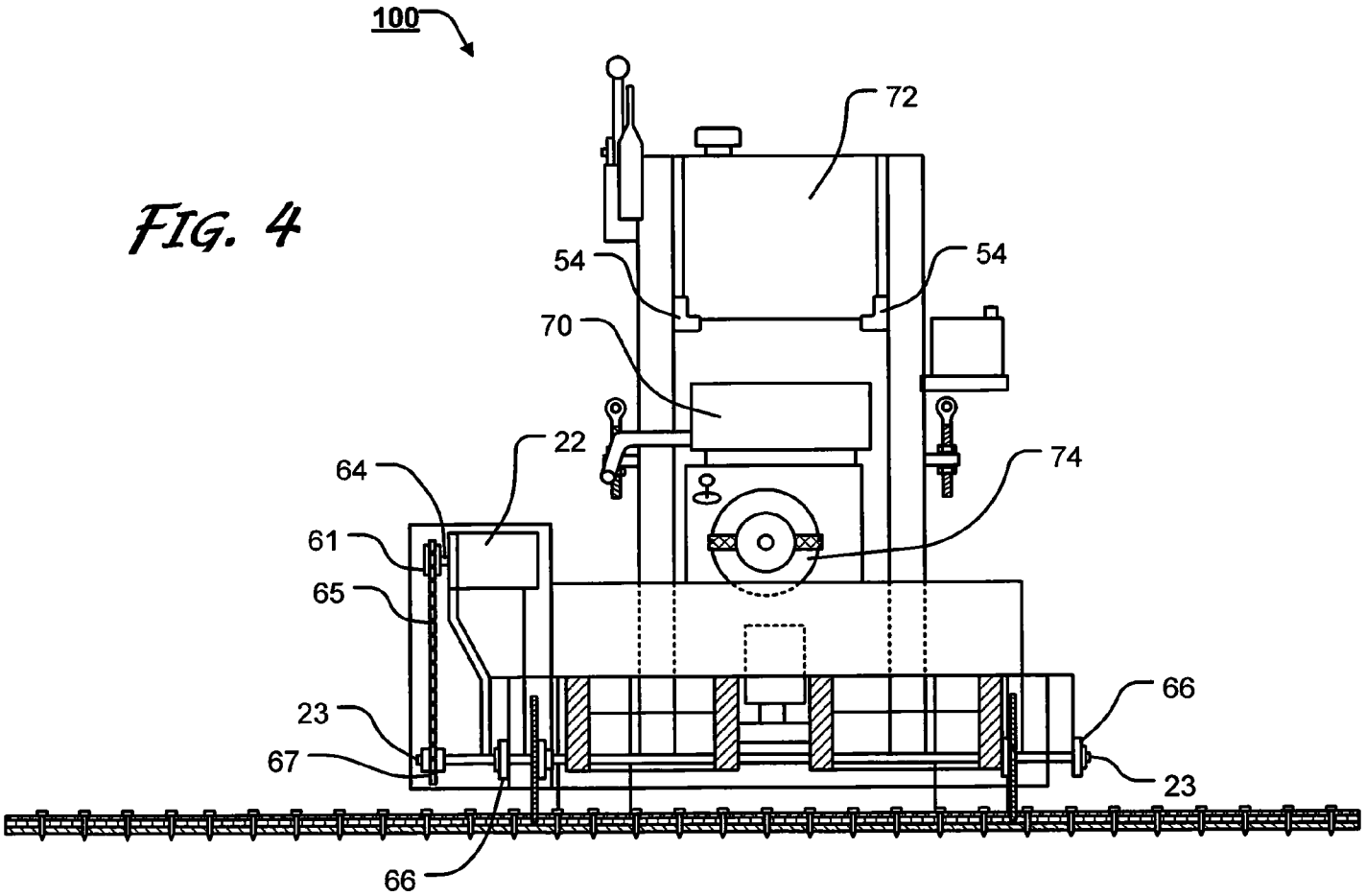
FIG. 4 shows a front view of a roofing material removal device according to this invention, wherein the hydraulic fluid conduits are detached.
Figure 5:
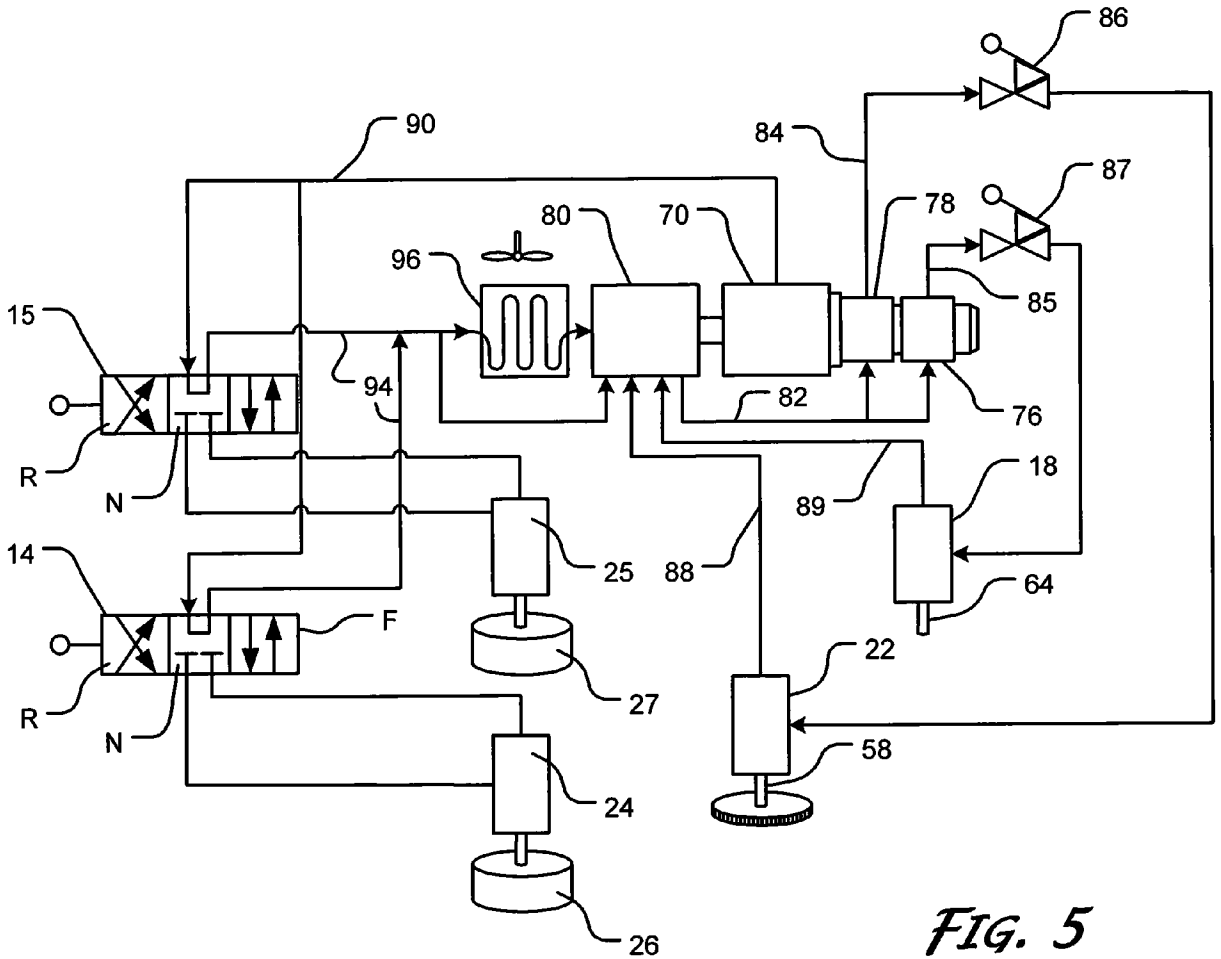
FIG. 5 shows a schematic diagram of the hydraulic system of the roofing material removal device according to this invention.
Figure 6:
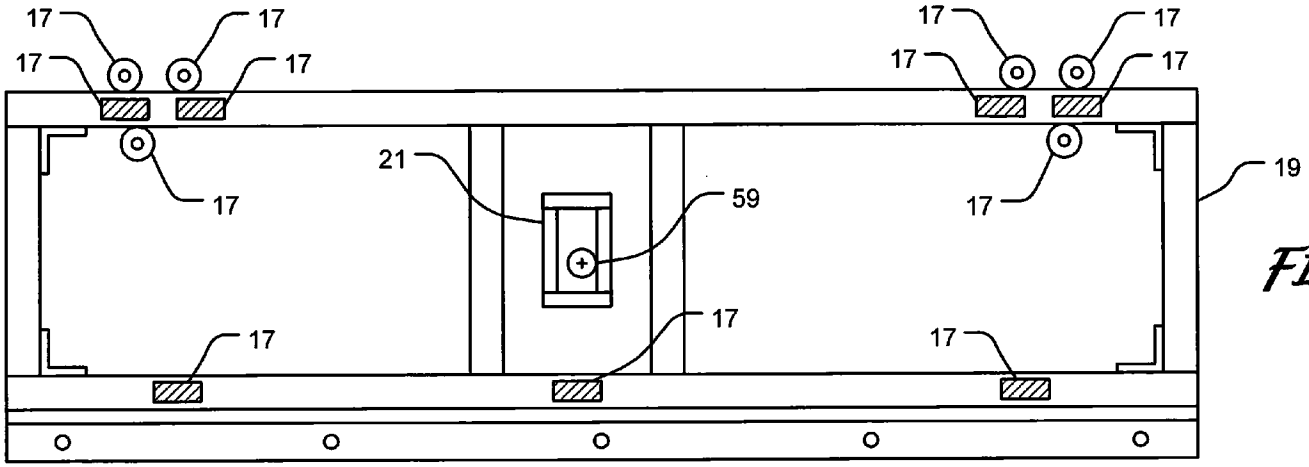
FIG. 6 shows a top view of a shuttle frame and the horizontal cutting blade assembly according to this invention.
Figure 7:
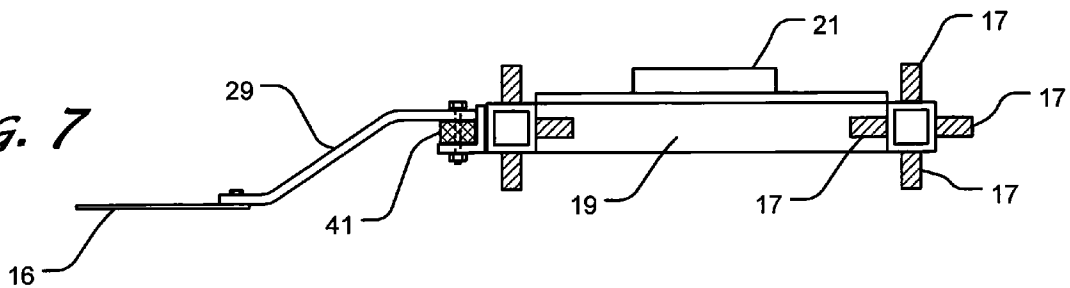
FIG. 7 shows a side view of a shuttle frame and the horizontal cutting blade assembly according to this invention.
Figure 8:
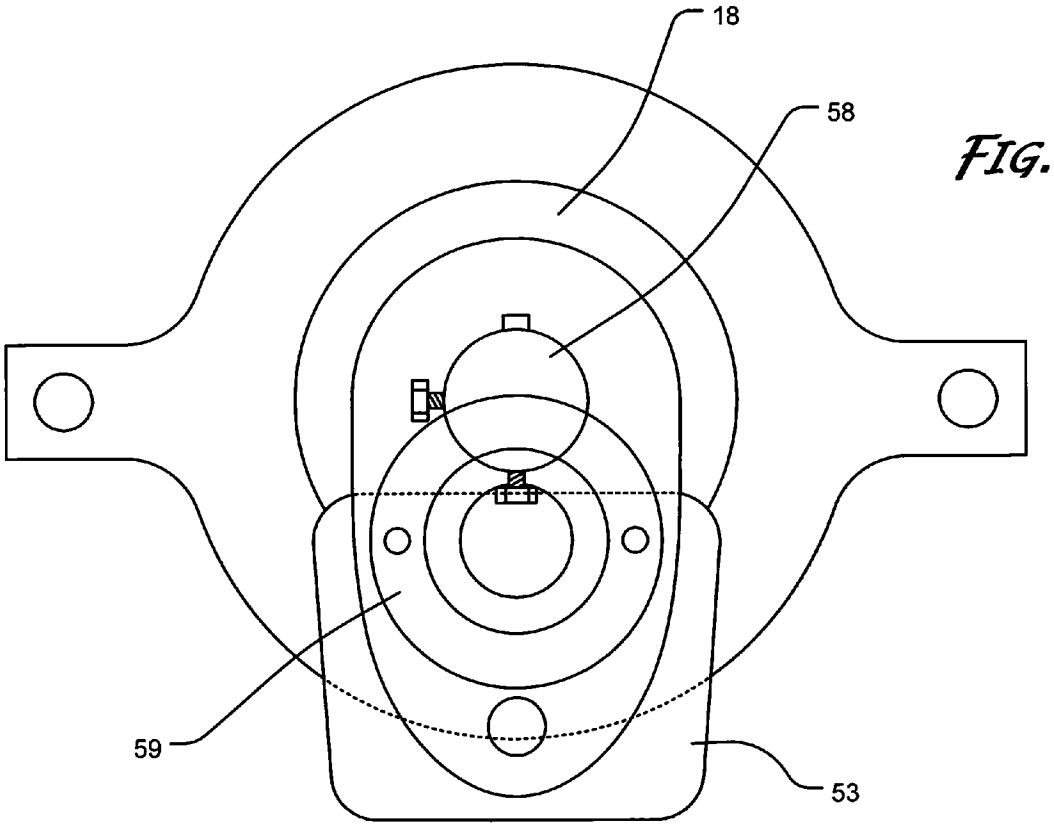
FIG. 8 shows a bottom view of the first hydraulic motor with counterbalance and eccentric and bearing for driving the horizontal cutting blade according to this invention.
Figure 9:
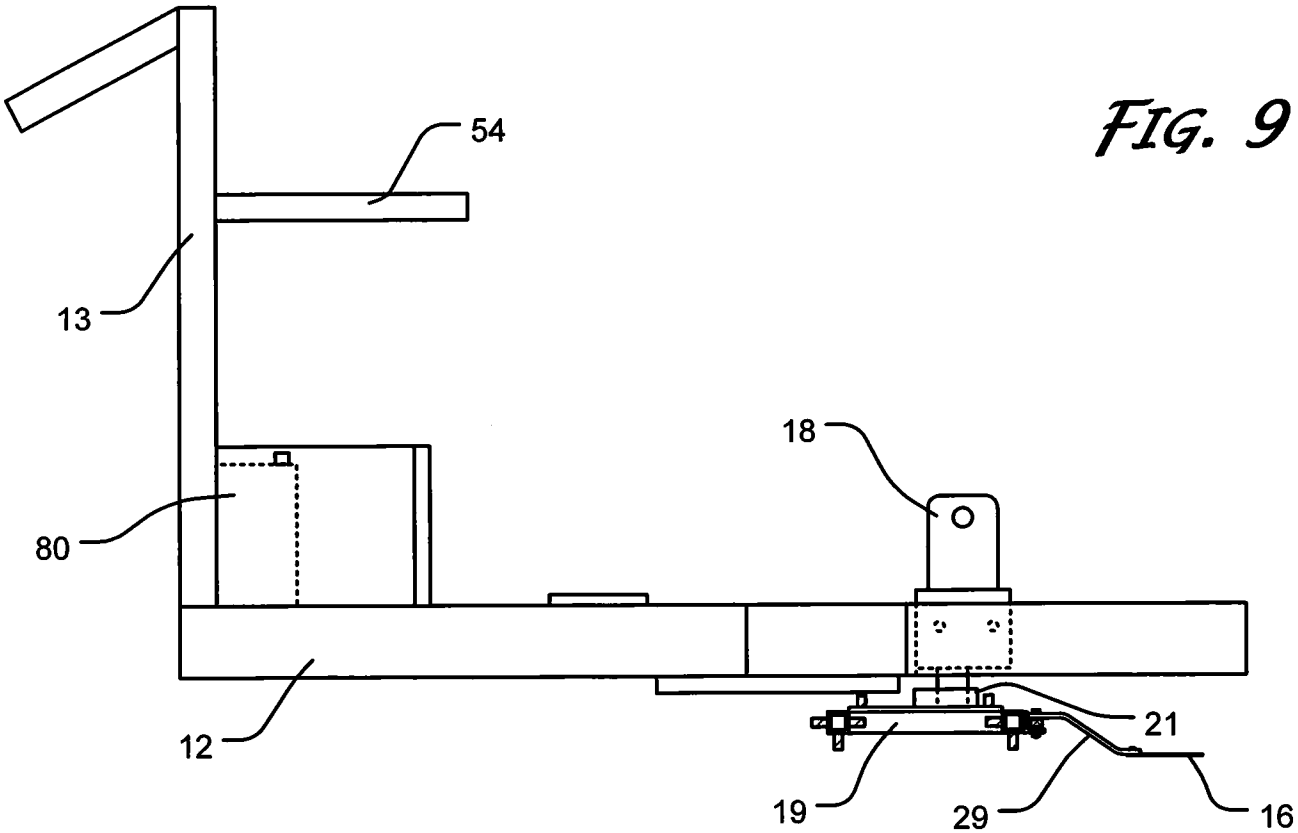
FIG. 9 shows a side view of the frame showing the location of the first hydraulic motor for driving the horizontal cutting blade according to this invention.
Figure 10:
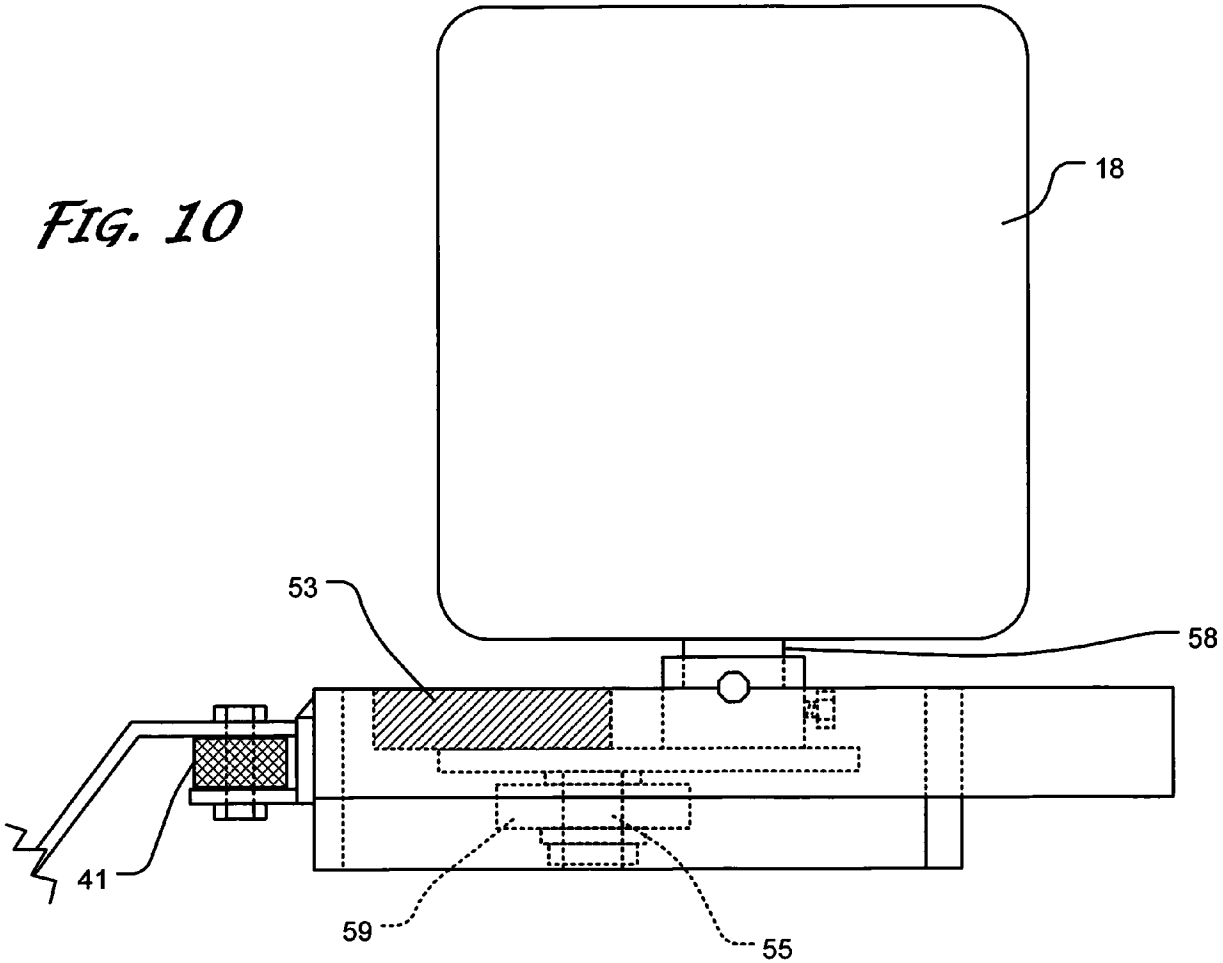
FIG. 10 shows a side view of the first hydraulic motor with counterbalance and eccentric and bearing for driving the horizontal cutting blade according to this invention.
Figure 11:
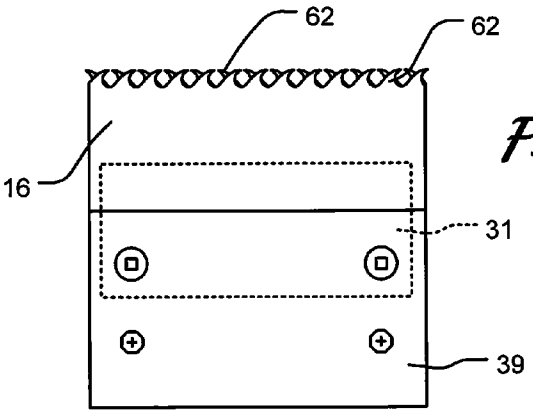
FIG. 11 shows a top view of an exemplary horizontal cutting blade according to this invention.
Figure 12:
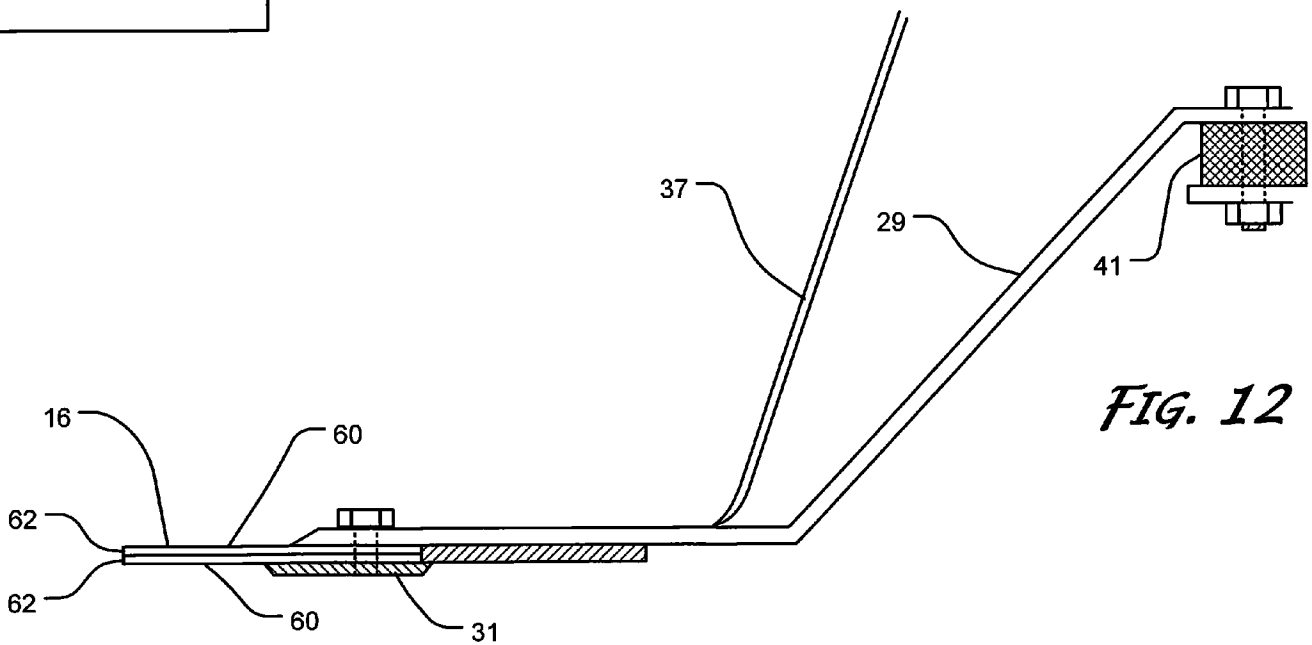
FIG. 12 shows a side view of the horizontal cutting blade and blade attachment plate according to this invention.
Figure 13:
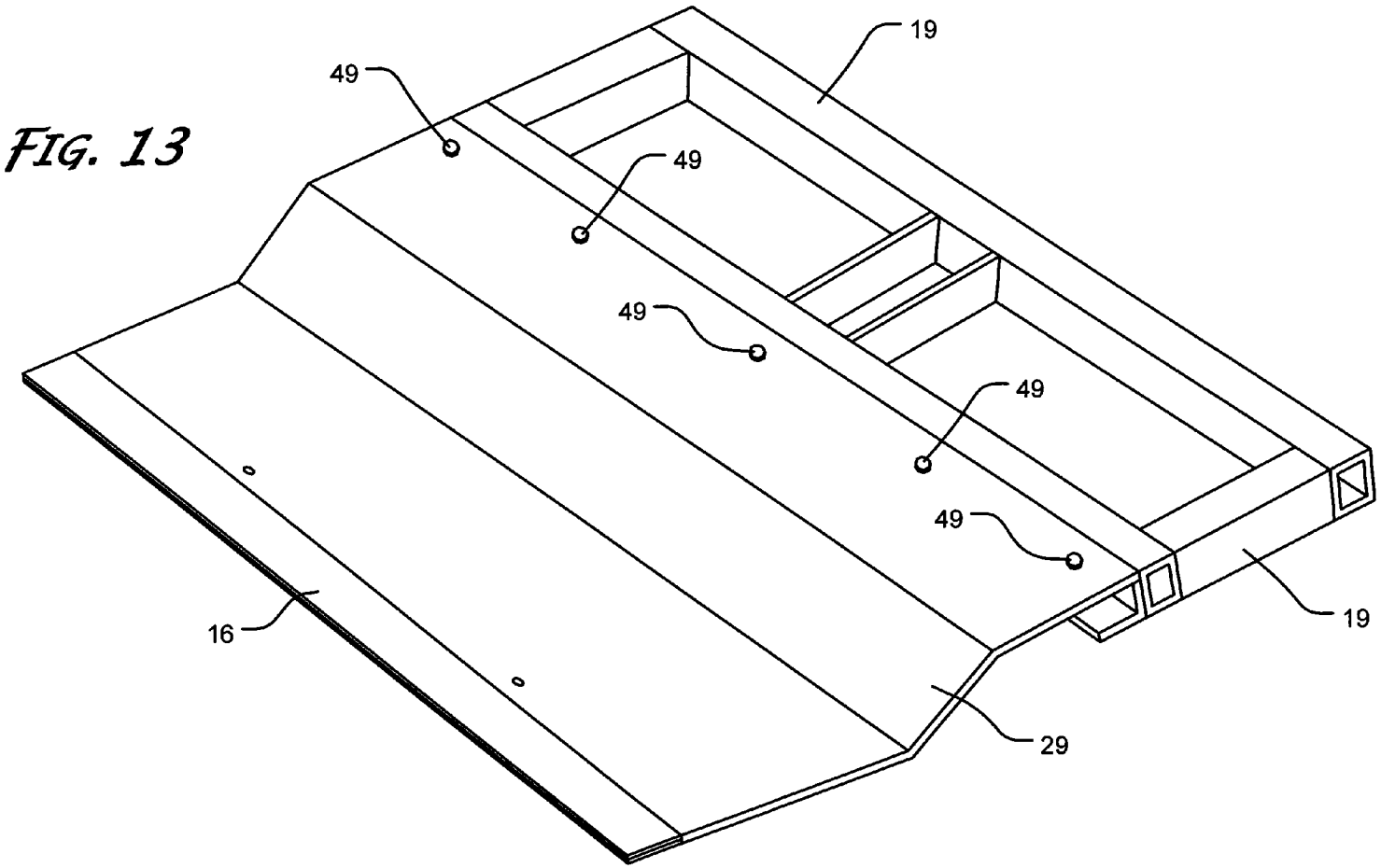
FIG. 13 shows a perspective view of the horizontal cutting blade, the blade attachment plate, the shuttle assembly, and the first hydraulic motor according to this invention.
Figure 14:
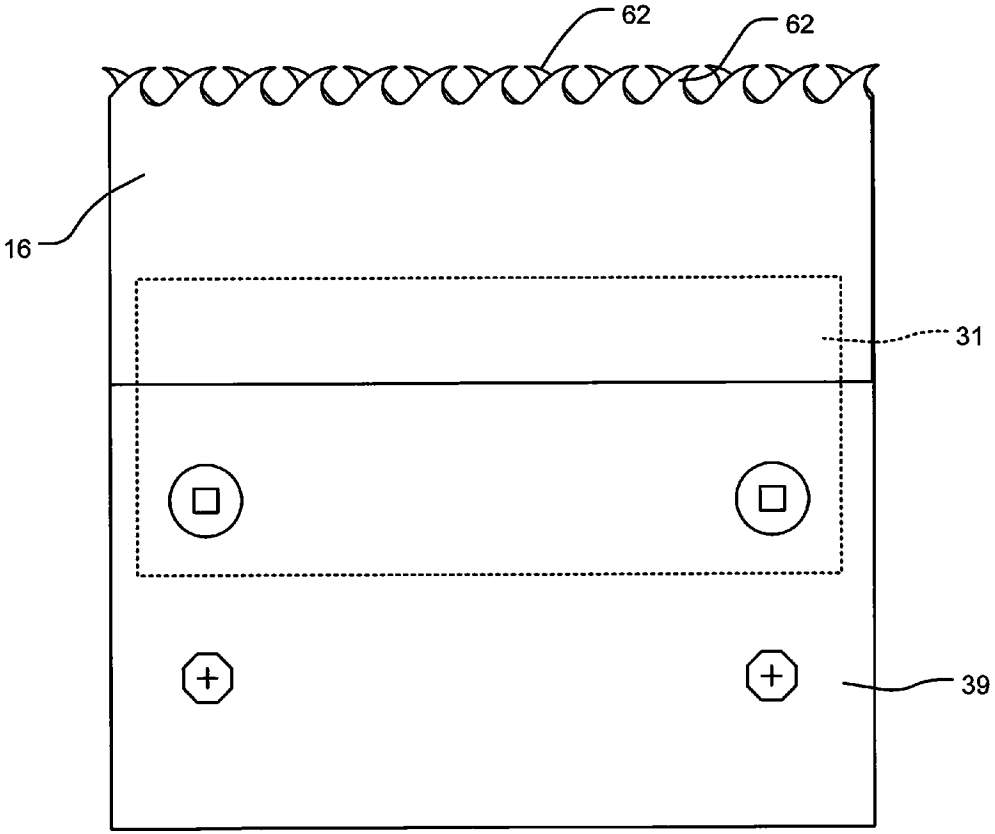
FIG. 14 shows a top view of an exemplary quick-change horizontal cutting blade according to this invention.
Figure 15:
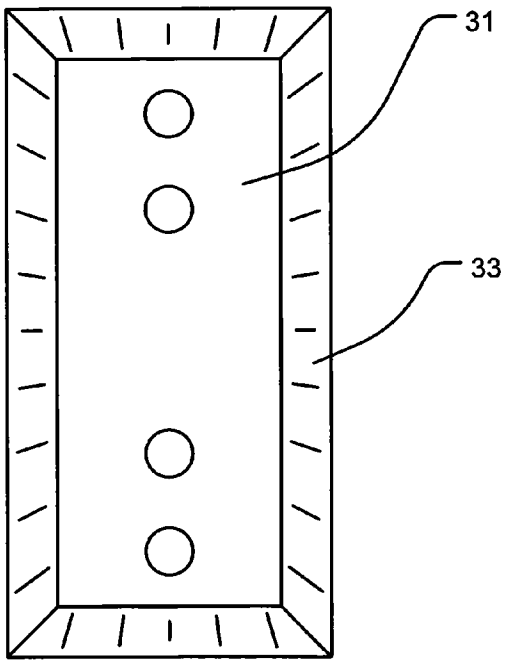
FIG. 15 shows a top view of an exemplary skid plate according to this invention

Turning now to the drawing figures, FIGS. 1-4 show various views of a first exemplary embodiment of a roofing material removal device according to this invention. FIG. 5 shows a schematic diagram of the hydraulic system of the roofing material removal device 100 according to this invention, while FIGS. 6-17 show various views of certain exemplary components of the roofing material removal device 100 of this invention.

As illustrated in FIGS. 1-17, the roofing material removal device 100 comprises a wheeled frame 12 having a pair of manually operated valves 14 and 15 at its rear for steering by a walking or riding attendant. The frame 12 supports a horizontal cutting blade 16, which is slidable, in a lateral motion, substantially along a horizontal plane by a hydraulic motor 18. A number of vertical cutting blades 20, which are rotatable about a substantially horizontal axis by a hydraulic motor 22, are also supported by the frame 12.

A hydraulic motor 24 drives a drive wheel 26 and a hydraulic motor 25 separately drives a drive wheel 27 to propel device 100 over a roof 28. Through manipulation of the manually operated valves 14 and 15, a user can control the motion of the device 100 over a roof 28.

During use, the rubber membrane 30, foam insulation 32, and/or fasteners 34 severed from roof decking 36 by the horizontal cutting blade 16 and/or the vertical cutting blades 20 are collected at the blade attachment plate for periodic disposal.

The frame 12 is substantially symmetrical about its longitudinal axis A. As such, frame 12 has a pair of laterally spaced side rails 38 that are mirror images of one another. Each of the side rails 38 has a front segment 40, positioned far from longitudinal axis A, which is connected to a rear segment 42, positioned near longitudinal axis A, by a medial segment 44. A respective one of a pair of gussets 46 reinforces the connection of a rear segment 42 to its associated medial segment 44. A front crosspiece 48 connects the rear ends of segments 40 together. A rear crosspiece 50 connects the rear ends of segments 42 together and a medial crosspiece 52 connects the front ends of segments 42 together.

A handlebar support 13 extends upwardly from the rear of each segment 42. A shelf 54 is connected to, and extends from the handlebar support 13 above crosspiece 50.

In various exemplary embodiments, a removable riding stand 11 extends from the rear of the frame 12 so as to allow an operator to stand on the device 100 while it is being operated.

Although not shown for the sake of drawing simplicity, crosspiece 48 is connected to side rail segments 40 in such a way that its position can be varied in terms of its elevation and pitch. Such a thing can be readily accomplished with the use of a pivot pin arrangement or by the provision of elongated slots in the ends of crosspiece 48 for receiving bolts extending from segments 40.

Since motor 18 and the horizontal cutting blade 16 are carried by crosspiece 48, the depth and angle of cut of the horizontal cutting blade 16 through membrane 30 and insulation 32 can be varied by repositioning crosspiece 48 to meet operating preferences. Selectively lowering crosspiece 48 increases the depth of cut of the horizontal cutting blade 16 and selectively increasing the forward pitch of crosspiece 48, increases the power of the horizontal cutting blade 16 to lift cut membrane 30 and insulation 32 from roof 28.

A set of wheels or casters 56 is secured to each gusset 46 to maintain the front of the frame 12 at a predetermined height above roof 28. In various exemplary embodiments, the casters 56 are capable of turning 360 degree about a vertical axes, permitting device 100 to be easily steered when pushed over roof 28.

In various exemplary embodiments, an additional set of wheels or casters 57 is secured to the frame 12 to help maintain proper balance of the device 100, to particularly when the removable riding stand 11 is used.

Lifting eyes 43 are optionally included at various points along the frame of the roofing material removal device 100 to allow device 100 to be lifted, for example, to be placed on a roof. A sufficient number of lifting eyes 43 are secured to the frame 12, handlebar support 13, and/or other portions of the device 100 to allow the device 100 to be safely lifted. It should be appreciated that the lifting eyes 43 are positioned so as to allow appropriate weight distribution of the device 100 amongst the lifting eyes 43.

Vertical cutting blades 20 are secured in a spaced-apart relationship along the length of the shaft 23. Each of the vertical cutting blades 20 is a disk that includes a peripheral edge having small teeth or, in the alternative, having imbedded abrasives about their peripheries for cutting purposes. Shaft 23 retains sprocket gears 67 that are engaged by an endless chain 65 and shaft 23 rotates in bearings 66 affixed to the front segment 40.

Motor 22 is secured to the front of one forward segment 40. Chain 65 is looped around a sprocket gear 61 affixed to the drive shaft 64 of hydraulic motor 22 and extends downwardly from sprocket gear 61. Thus, because sprocket gear 67 is connected, via endless chain 65, to sprocket gear 61, when shaft 64 of hydraulic motor 22 rotates, shaft 23 also rotates. As shaft 23 rotates, the vertical cutting blades 20 are caused to rotate to make vertical cuts through membrane 30 and insulation 32.

The drive shaft 58 of the motor 18 extends downwardly from the bottom of crosspiece 48. A counterbalance 53, eccentric 55, and bearing assembly 59 are secured to the drive shaft 58.

The horizontal cutting blade 16 comprises one or more elongate blades 60. Each of the elongate blades 60 is provided with a sharpened, leading, cutting edge 62 that is capable of cutting membrane 30, insulation 32, and fasteners 34 horizontally, or at a shallow angle, when traveling in a lateral, cutting motion. Alternatively, elongate blades 60 can include leading edge portions that have small teeth or imbedded abrasives for cutting purposes.

The horizontal cutting blade 16 is removably attached to a first end portion of a blade drop bar or blade attachment plate 29. The second end portion of the blade attachment plate 29 is removably attached to a frame structure or shuttle assembly 19. The blade attachment plate 29 is formed so as to provide a vertical drop between the shuttle assembly 19 and the horizontal cutting blade 16.

In various exemplary embodiments, a backplate 39 is attached or coupled to the blade attachment plate 29. A rear surface of the elongate blades 60 can be abutted against the backplate 39 so as to help maintain the elongate blades 60 in a desired position. In certain exemplary embodiments, a skid plate 31 is attached or coupled below the attachment plate 29 so as to provide a surface for the horizontal cutting blade 16 to contact decking 36 or other ground surfaces. The skid plate 31 may include beveled edges 33, which allow the skid plate 31 to more easily slide across a contacting surface.

The shuttle assembly 19 is slidably coupled to the frame 12, via a plurality of guide bearings 17. Because of the positioning of guide bearings 17, the shuttle assembly 19 and, in turn, the horizontal cutting blade 16, is slidable on a horizontal plane relative to the frame 12. A cam 21 is provided substantially central to the frame 19, which accept at least a portion of the bearing 59.

The cam 21 is shaped such that when the bearing 59 is rotated by the rotation of shaft 58 of the motor 18, the bearing 59 is maintained within the cam 21. The shape of the cam 21 is also such that when the bearing 59 is rotated, the shuttle assembly and, in turn, the horizontal cutting blade 16, moves in a lateral direction, as guided by the guide bearings 17, in a horizontal cutting motion.

Drive wheels 26 and 27 are rotatably positioned proximate the rear of the frame 12 to maintain the rear of the frame 12 at a set height above roof 28. Each of drive wheels 26 and 27 is secured to the drive shaft 68 and 69, respectively, of motors 24 and 25, respectively, secured below crosspiece 50. Drive wheels 26 and 27 can be selectively rotated by motor 24 and 25, respectively, to drive device 100 forward or backward or to turn the device 100 in a clockwise or counterclockwise manner.

In various exemplary embodiments, an internal combustion engine 70, powered by liquid fuel from a tank 72 supported by shelf 54, is mounted atop crosspiece 52 so as to power a two-stage pump 74. Pump 74 is fastened directly to engine 70 and has two, separate, pumping units 76 and 78 being capable of delivering separate streams of hydraulic fluid under pressure at predetermined flow rates. Pumping unit 76 has a fluid inlet and a fluid outlet that do not communicate directly with the fluid inlet and outlet of pumping unit 78.

While engine 70 is running, hydraulic fluid is delivered from a reservoir 80 to pumping units 76 and 78 through a suction conduit 82. Hydraulic fluid is discharged from pumping unit 76 into a discharge conduit 84 for delivery to hydraulic motor 22. Discharge conduit 84 is provided with a manually operated to valve 86 that selectively permits the flow of hydraulic fluid to hydraulic motor 22 connected in series with reservoir 80. (Note: bypass conduits permitting the continuous pumping of fluid by pump 76 are not shown in the FIGS. for the sake of simplicity.) When hydraulic fluid flows through hydraulic motor 22 the hydraulic motor 22 is operated to rotate drive shaft 58 and vertical cutting blades 20 through the transmission system previously described. Hydraulic fluid exiting hydraulic motor 22 is returned to reservoir 80 via return conduit 88.

Likewise, while engine 70 is running, hydraulic fluid is delivered from reservoir 80 to pumping units 76 and 78 through a suction conduit 82. Hydraulic fluid is discharged from pumping unit 76 into a discharge conduit 85 for delivery to hydraulic motor 18. Discharge conduit 85 is provided with a manually operated valve 87 that selectively permits the flow of hydraulic fluid to hydraulic motor 18 connected in series with reservoir 80. When hydraulic fluid flows through hydraulic motor 18 the hydraulic motor 18 is operated to rotate drive shaft 58 and horizontal cutting blade 16 as previously described. Hydraulic fluid exiting hydraulic motor 18 is returned to reservoir 80 via return conduit 89.

Hydraulic fluid is delivered from a reservoir 80 to high-pressure pumping unit 78 through suction conduit 82 while engine 70 is operating. Hydraulic fluid is discharged from pumping unit 78 into a discharge conduit 90 for delivery to hydraulic motors 24 and 25. Discharge conduit 90 is provided with a pair of manually operated valves 14 and 15 that respectively control the flow of hydraulic fluid to hydraulic motors 24 and 25.

Each of the manually operated valves 14 and 15 is shown in FIG. 5 to be situated so that its segment N is engaged with conduit 90 whereby hydraulic fluid flows to and from the valves 14 and 15 into return conduit 94 without accomplishing useful work, meaning that device 100 remains in neutral or at rest. Should both of valves 14 and 15 be shifted so that its F segment is engaged with conduit 90, hydraulic fluid is permitted to flow to motors 24 and 25 to rotate drive shafts 68 and 69 and drive wheels 26 and 27 so as to move device 100 forward. If, however, both valves 14 and 15 are shifted so that its R segment is engaged with conduit 90, hydraulic fluid is permitted to flow to motors 24 and 25 so as to rotate shafts 68 and 69 and drive wheels 26 and 27 to move device 100 backward or in reverse. Similarly, if valve 14 is shifted so that its F segment is engaged with conduit 90 and the valve 15 is shifted so that its R segment is engaged with conduit 90, device 90 will be caused to turn under its own power in a counterclockwise manner when viewed from above.

To avoid overheating the hydraulic fluid, a portion of its flow is diverted from return conduit 94 to a cooler 96 mounted on the frame 12. After the hydraulic fluid passes through cooler 12, it is discharged into reservoir 80. Once in reservoir 80, the hydraulic fluid can be withdrawn to power any of the hydraulic motors 18, 22, 24, and/or 25.

From the foregoing, it should be appreciated that the use of device 100 is straightforward. First, device 100 is placed on roof 28. Next, membrane 30 and insulation 32 are exposed to horizontal cutting blade 16 and vertical cutting blades 20. Then, as the manually operated valves 14 and 15 are operated to energize motors 24 and 25 drive wheels 26 and 27 rotate and drive device 100 forward. The forward movement of device 100 presses the horizontal cutting blade 16 and vertical cutting blades 20 against membrane 30, insulation 32, and fasteners 34 used for anchoring purposes.

Now, valve 86 is opened to energize motor 18 and valve 87 is opened to energize motor 22 thereby causing the horizontal cutting blade 16 and vertical cutting blades 20 to rotate and cut the membrane 30, insulation 32, and fasteners 34. Cutting of membrane 30, insulation 32, and fasteners 34 proceeds rapidly with device 100 moving at a walking pace. The membrane 30, insulation 32, and fasteners 34 are cut into small pieces.

In certain exemplary embodiments, one or more debris guides 37 are included so as to help guide or direct cut and/or removed debris through or around the components of the device 100.

If, during operation of the device 100, the horizontal cutting blade 16 appears to be scraping upon decking 36, the horizontal cutting blade 16 can be raised by adjusting the height or pitch of crosspiece 48 as described hereinabove.

Because device 100 is highly maneuverable, the process of removing a membrane 30, its underlying insulation 32, and associated fasteners 34 from a roof 28 can be accomplished in substantially less time than required when using conventional tools regardless of the skill of the user. A job that formerly would have required weeks to complete can now be completed in days.

Figure 16:
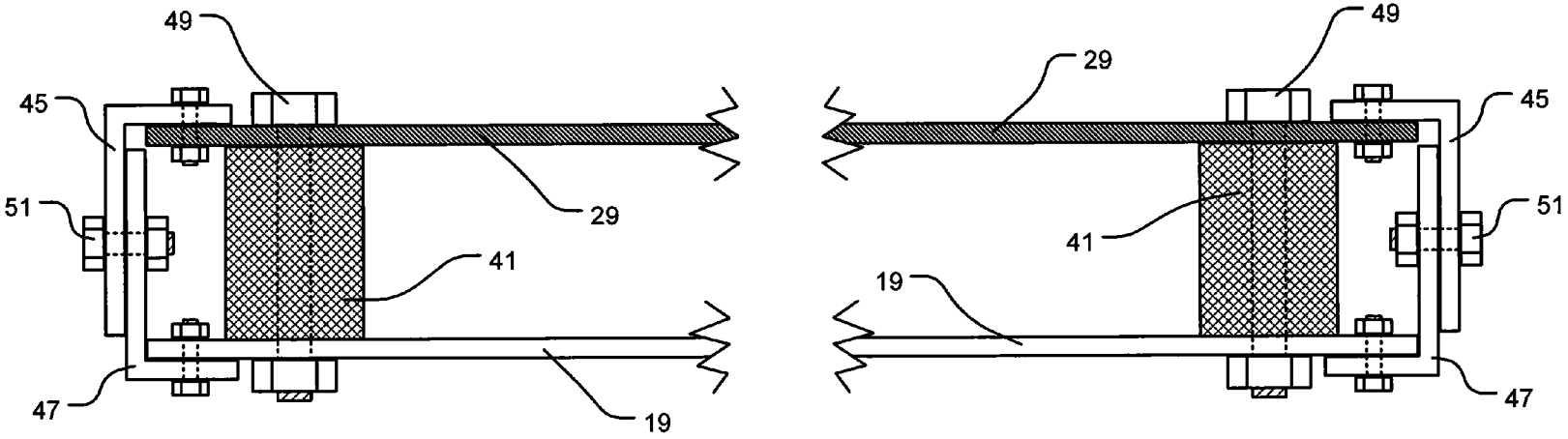
FIG. 16 shows a more detailed front view of a portion of the blade attachment plate attached to the shuttle assembly according to this invention.
Figure 17:
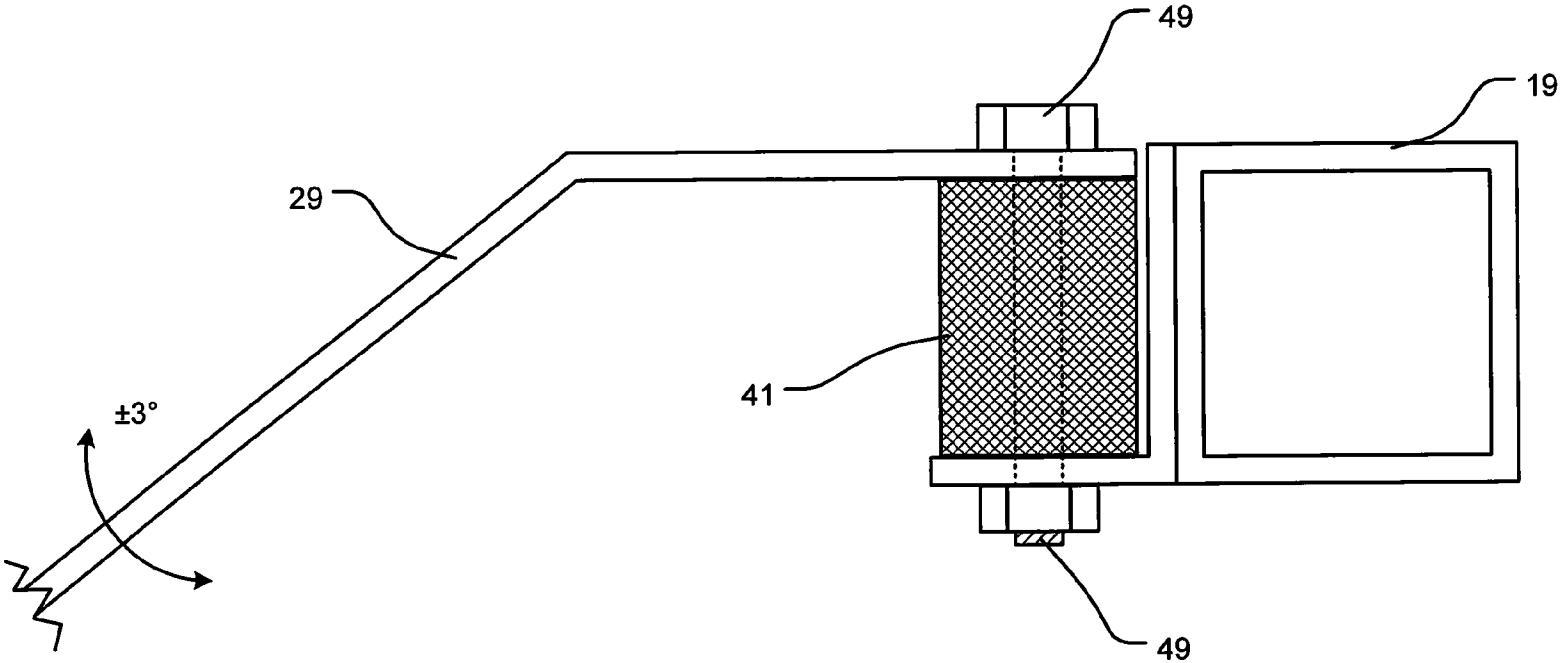
FIG. 17 shows a more detailed side view of a portion of the blade attachment plate attached to the shuttle assembly according to this invention.

As illustrated most clearly in FIGS. 16 and 17, the blade attachment plate 29 is coupled to the shuttle assembly 19 via a plurality of bolts 49 and rubber spacers 41. The rubber spacers 41 are placed between the blade attachment plate 29 and the shuttle assembly 19 so as to provide for a degree of flexibility between the blade attachment plate 29 and the shuttle assembly 19. In various exemplary embodiments, the rubber spacers 41 provide at least plus or minus 3° of movement to the blade attachment plate 29 in relation to the shuttle assembly 19.

It should be appreciated that the actual size, shape, and material of construction of each rubber spacer 41 is a design choice based upon the desired resilience and functionality of the rubber spacer 41. In certain exemplary embodiments, each rubber spacer 41 is generally cylindrical in shape. Alternatively, each rubber spacer 41 may comprise a generally rectangular, conical, spherical, or other geometric shape.

It should also be appreciated that each rubber spacer 41 may be constructed of a material that provides a desired density and/or resilience. Thus, the degree of flexibility between the blade attachment plate 29 and the shuttle assembly 19 can be altered based upon the material used to construct the rubber spacers 41.

As illustrated in FIG. 16, an attachment and pivot point may optionally be formed on each end of the shuttle assembly 19 by the inclusion of a first L-shaped pivot bar 45 and a second L-shaped pivot bar 47. The first L-shaped pivot bar 45 is removably attached or coupled to an upper portion of the shuttle assembly 19, while the second L-shaped pivot bar 47 is removably attached or coupled to a lower portion of the shuttle assembly 19. Portions of the first L-shaped pivot bar 45 and the second L-shaped pivot bar 47 overlap to allow a bolt 51 to join the overlapping portions of the first L-shaped pivot bar 45 and the second L-shaped pivot bar 47 such that the first L-shaped pivot bar 45 and the second L-shaped pivot bar 47 are pivotable, about the bolt 51, with relation to one another.

While this invention has been described in conjunction with the exemplary embodiment(s) outlined above, it is evident that this invention is not limited to particular variation(s) set forth and many alternatives, adaptations, modifications, and variations will be apparent to those skilled in the art.

For example, the number and location of horizontal cutting blade 16 can be increased or decreased to suit the needs of a particular user.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Such alternatives, adaptations, modifications, and variations should and are intended to be and are comprehended within the meaning and range of equivalents of the disclosed exemplary embodiment(s) and may be substituted without departing from the true spirit and scope of the invention. It is to be understood that the phraseology of terminology employed herein is for the purpose of description and not of limitation. Accordingly, the foregoing description of the exemplary embodiments of the invention, as set forth above, are intended to be illustrative, not limiting and the fundamental design should not be considered to be necessarily so constrained. Various changes, modifications, and/or adaptations may be made without departing from the spirit and scope of this invention.

What is claimed is:

1. A roofing material removal device, comprising:

a wheeled frame;

a plurality of vertical cutting blades being secured to a front of said wheeled frame, each of said vertical cutting blades being rotatable about a substantially horizontal axis;

at least one horizontal cutting blade being secured to said wheeled frame, said horizontal cutting blade being slidable in a lateral motion along a substantially horizontal plane;

a first motor being coupled to said vertical cutting blades for rotating said vertical cutting blades; and a second motor being coupled to said horizontal cutting blade for moving said horizontal cutting blade in a lateral motion.

2. The roofing material removal device of claim 1, further comprising one or more debris guides coupled to said frame to direct cut and/or removed debris through or around the components of the roofing material removal device.

3. The roofing material removal device of claim 1, wherein said wheeled frame further comprises a handlebar support.

4. The roofing material removal device of claim 3, wherein said horizontal cutting blade is secured to said frame between said plurality of vertical cutting blades and said handlebar support.

5. The roofing material removal device of claim 1, wherein said at least one horizontal cutting blade is secured to said wheeled frame via a blade attachment plate and a shuttle assembly and wherein said blade attachment plate is coupled to said shuttle assembly via one or more rubber spacers.

6. The roofing material removal device of claim 1, further comprising a removable riding stand that extends from a rear portion of said frame.

7. The roofing material removal device of claim 1, wherein each of said vertical cutting blades comprises a disk that includes a peripheral edge having small teeth.

8. The roofing material removal device of claim 1, wherein each of said vertical cutting blades comprises a disk that includes a peripheral edge having imbedded abrasives about said periphery edge for cutting purposes.

9. The roofing material removal device of claim 1, wherein said first motor is coupled to said vertical cutting blades via a chain.

10. The roofing material removal device of claim 1, wherein said second motor is coupled to said frame by a crosspiece that can be selectively raised or lowered relative to said frame.

11. The roofing material removal device of claim 1, wherein a counterbalance, eccentric, and bearing assembly are secured to a driveshaft of said second motor for moving said horizontal cutting blade in said lateral motion.

12. The roofing material removal device of claim 1, wherein said horizontal cutting blade comprises one or more elongate blades and wherein each of said elongate blades is provided with a sharpened, leading, cutting edge.

13. A roofing material removal device, comprising:

a wheeled frame;

a pair of drive wheels being secured to a rear portion of said frame for propelling said device;

a plurality of vertical cutting blades being secured to a front of said wheeled frame, each of said vertical cutting blades being rotatable about a substantially horizontal axis;

at least one horizontal cutting blade being secured to said wheeled frame, said horizontal cutting blade being slidable in a lateral motion along a to substantially horizontal plane;

a first motor being coupled to said vertical cutting blades for rotating said vertical cutting blades;

a second motor being coupled to said horizontal cutting blade for moving said horizontal cutting blade in a lateral motion;

a third motor being connected to one of said drive wheels for rotating said drive wheel; and a forth motor being connected to one of said drive wheels for rotating said drive wheel.

14. The roofing material removal device of claim 13, further comprising one or more debris guides coupled to said frame to direct cut and/or removed debris through or around the components of the roofing material removal device.

15. The roofing material removal device of claim 13, wherein said at least one horizontal cutting blade is secured to said wheeled frame via a blade attachment plate and a shuttle assembly and wherein said blade attachment plate is coupled to said shuttle assembly via one or more rubber spacers.

16. The roofing material removal device of claim 13, wherein said at least one horizontal cutting blade is secured to said wheeled frame via a blade attachment plate and a shuttle assembly and wherein said blade attachment plate is coupled to said shuttle assembly via one or more rubber spacers.

17. A roofing material removal device, comprising:

a wheeled frame;

a source of pressurized hydraulic fluid being secured to said frame;

a pair of drive wheels being secured to a rear portion of said frame for propelling said device;

a plurality of vertical cutting blades being secured to a front of said wheeled frame, each of said vertical cutting blades being rotatable about a substantially horizontal axis;

at least one horizontal cutting blade being secured to said wheeled frame, said horizontal cutting blade being slidable in a lateral motion along a substantially horizontal plane;

a first motor being connected to said source of pressurized hydraulic fluid and being coupled to said vertical cutting blades for rotating said vertical cutting blades;

a second motor being connected to said source of pressurized hydraulic fluid and being coupled to said horizontal cutting blade for moving said horizontal cutting blade in a lateral motion;

a third motor being connected to said source of pressurized hydraulic fluid and being connected to one of said drive wheels for rotating said drive wheel; and a forth motor being connected to said source of pressurized hydraulic fluid and being connected to one of said drive wheels for rotating said drive wheel.

18. The roofing material removal device of claim 17, further comprising one or more debris guides coupled to said frame to direct cut and/or removed debris through or around the components of the roofing material removal device.

19. The roofing material removal device of claim 17, wherein said at least one horizontal cutting blade is secured to said wheeled frame via a blade attachment plate and a shuttle assembly and wherein said blade attachment plate is coupled to said shuttle assembly via one or more rubber spacers.

20. The roofing material removal device of claim 17, further comprising a pair of manually operated valves for steering said roofing material removal device.

* * * * *